United States Patent [19]

Moore et al.

[11] Patent Number: 4,744,181

[45] Date of Patent: May 17, 1988

[54] PARTICLE-BLAST CLEANING APPARATUS AND METHOD

[76] Inventors: David E. Moore, 212 Southampton Rd., Louisville, Ky. 40223; Newell D. Crane, 5988 Woodridge Dr., Milford, Ohio 45150

[21] Appl. No.: 931,604

[22] Filed: Nov. 17, 1986

[51] Int. Cl.[4] ..... B24B 1/00; B24C 1/00; B08B 7/00

[52] U.S. Cl. ..... 51/436; 51/320; 51/322; 134/7

[58] Field of Search ..... 51/436, 320, 319, 321, 51/322, 437, 438, 410, 439; 222/636; 134/7, 12, 13

[56] References Cited

U.S. PATENT DOCUMENTS

| | | | |
|---|---|---|---|
| 2,421,753 | 6/1947 | Joyce | 62/104 |
| 3,110,983 | 11/1963 | Moore | 51/9 |
| 3,137,101 | 6/1964 | Leliaert | 51/13 |
| 3,160,993 | 12/1964 | McCormick | 51/9 |
| 3,272,396 | 9/1966 | Neville | 222/636 |
| 3,324,605 | 6/1967 | Lester | 51/314 |
| 3,422,580 | 1/1969 | Balz | 51/314 |
| 3,485,074 | 12/1969 | Compton | 72/53 |
| 3,676,963 | 7/1972 | Rice et al. | 51/320 |
| 3,702,519 | 11/1972 | Rice et al. | 51/310 |
| 3,768,210 | 10/1973 | Johnson et al. | 51/12 |
| 4,038,786 | 8/1977 | Fong | 51/320 |
| 4,617,064 | 10/1986 | Moore | 134/7 |
| 4,655,847 | 4/1987 | Ichinoseki | 134/7 |

*Primary Examiner*—Frederick R. Schmidt
*Assistant Examiner*—Blynn Shideler
*Attorney, Agent, or Firm*—Frost & Jacobs

[57] ABSTRACT

An improved particle-blast cleaning apparatus and process featuring sublimable pellets as the particulate media is described as including a source of sublimable pellets, housing means having laterally spaced pellet receiving and discharge stations, and pellet feeder means for transporting the pellets from the receiving station to the discharge station. The pellet feeder means further includes a plurality of reciprocating feeder bars each having a transport bore formed therein to receive the pellets for lateral transport between the receiving and discharge stations. Means for providing gravity flow of the pellets to the transport bores at the receiving station are included, as is a discharge nozzle and means for supplying a pressurized transport gas at the discharge station for conveying the pellets from the discharge station to the discharge nozzle.

22 Claims, 3 Drawing Sheets

PARTICLE-BLAST CLEANING APPARATUS AND METHOD

TECHNICAL FIELD

This invention relates to a particle-blast cleaning apparatus and method, and, more particularly, to an improved apparatus and method for transporting sublimable particulate media from a receiving station to a discharge station within such a particle-blast cleaning apparatus.

BACKGROUND ART

Particle-blast cleaning apparatus are well known in the industry. While sandblasting equipment is widely used for many applications, it has been found that the utilization of particles which naturally sublimate can advantageously be utilized as the particulate media of such equipment to minimize adverse environmental facts and cleanup required following the cleaning activity. For example, U.S. Pat. No. 4,617,064, which issued to the present inventor Moore on Oct. 14, 1986, discloses a particle-blast cleaning apparatus utilizing carbon dioxide pellets and a high pressure carrier gas. The particular particle-blast apparatus described in the '064 patent includes a body which houses a rotary pellet transport mechanism to convey the carbon dioxide pellets from a gravity feed storage hopper to the high pressure carrier gas stream for application of the pellets to a discharge nozzle. In order to ensure that the high pressure gas does not leak into the rotary transport apparatus, a rather complex system of variable pressure gas seals is necessary.

While the apparatus and method described in the '064 reference can successfully be utilized to accomplish particle-blast cleaning, the structure and its function has some very important practical drawbacks. In particular, due to the requirement that the high pressure gas be prevented from leaking into the system at the receiving station, this apparatus requires a rather complex set of circular face seals for providing an airtight seal of the rotary apparatus as it is rotated about a central axis. In this regard, the rotary apparatus is fitted with a corresponding set of circular face seals, and means to establish a force on such seals which is proportional in magnitude to the pressure of the transport gas. In order to achieve and maintain this critical sealing function, the circular seals must remain substantially flat in order to remain in intimate, continuous contact with the surfaces to be sealed. Consequently, the sealing surfaces must withstand a relatively great amount of friction, with such friction being applied at varying rubbing velocities across the diameter of such circular seals. The rubbing velocity and friction differentials, of course, tend to wear the seals at correspondingly differing rates creating a relatively difficult seal maintenance problem. Additionally, it has been found that the seal surface becomes subjected to erosion in critical sealing areas adjacent the receiving station due to occasional shearing of the particulate media at the cavity/receiving station interface. Moreover, the uneven wearing pattern and relatively high friction involved in maintaining these seals has been found to compromise the flatness of such seals, and in particular tends to warp the circular sealing surfaces thereby tending to reduce the effectiveness thereof. Finally, it has been found that the necessary spacing of adjacent cavities within the rotary transport means results in a slight time delay between successive discharges of pellets therefrom, causing a somewhat non-uniform or pulsating discharge of the particulate media from the apparatus. Although it has been contemplated that additional rotary mechanisms might be added to attempt to obviate such pulsating particulate delivery, it appears that the manifolding and synchronizing requirements necessary to appropriately combine additional rotary mechanisms is relatively complex and would require inefficient duplication of other parts of the system. Maintenance problems would, of course, correspondingly be multiplied.

Consequently, despite the prior work done in this area, there remain problems of economically and reliably achieving and maintaining a proper seal between the particulate media transporting apparatus and the high pressure conveying gas required to discharge such particulate media. Additionally, prior art apparatus and processes fail to achieve a relatively uniform delivery of sublimable particulate media in an economical and relatively simple manner. Consequently, prior art structures and processes delivered a relatively inefficient system with rather high maintenance costs.

DISCLOSURE OF THE INVENTION

It is an object of this invention to obviate the above-described problems.

It is another object of the present invention to provide an improved particle-blast cleaning apparatus featuring sublimable pellets as the particulate media and utilizing an improved pellet feeder means and process comprising a plurality of reciprocating feeder bars.

It is yet another object of the present invention to achieve an improved particle-blast cleaning apparatus capable of economically providing a relatively uniform flow of sublimable pellets in a stream of pressurized transport gas to a discharge nozzle.

It is also an object of the present invention to provide an improved apparatus and method for laterally transporting sublimable pellets in a particle-blast cleaning apparatus, with such apparatus featuring reliable seals therewithin which can be easily maintained.

In accordance with one aspect of the present invention, there is provided an improved particle-blast cleaning apparatus featuring sublimable pellets as the particulate media, with such apparatus including a source of sublimable pellets, a housing means having pellet receiving and discharge stations, and a pellet feeder means for transporting the pellets from the receiving station to the discharge station. Such feeder means includes a plurality of reciprocating feeder bars each having a transport bore formed therewithin to receive the pellets for lateral transport between such stations. The apparatus further includes means for providing gravity flow of the pellets to the transport bores at the receiving station, a discharge nozzle, and means for supplying a pressurized transport gas at the discharge station for conveying the pellets from the discharge station to the discharge nozzle.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
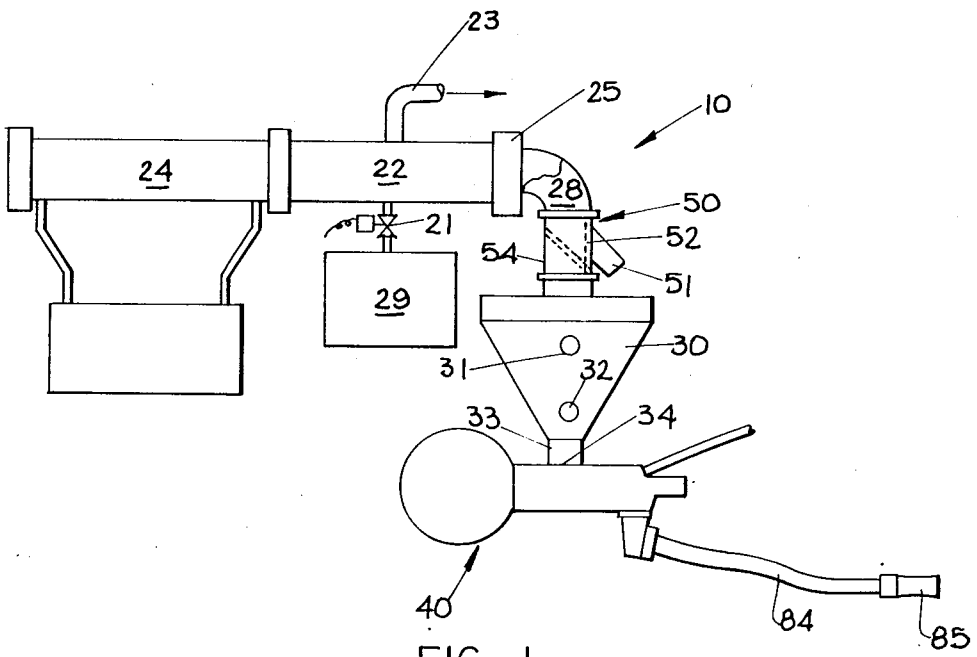
FIG. 1 is an elevational view in schematic form illustrating a preferred embodiment of the particle-blast cleaning apparatus of the present invention.

Referring now to the drawings in detail, wherein like numerals indicate the same elements throughout the views, an improved particle-blast cleaning apparatus 10 of the present invention is shown in FIG. 1. In particular, cleaning system 10 is illustrated in the form it would most preferably take for use wherein the particulate media is formed from liquid carbon dioxide. Such liquid carbon dioxide is stored in a storage chamber 29 at relatively high pressure (e.g. about 300 psi) prior to injection via inlet 21 into a pellet extrusion cylinder 22 at atmospheric pressure where such liquid carbon dioxide passes into the solid stage.

Liquid carbon dioxide ($CO_2$) is maintained at about 300 psi and about 0° F. (−18° C.) in storage chamber 29 prior to being injected via the inlet 21 into extrusion cylinder 22 which is maintained at atmospheric pressure. Due to the sudden drop in pressure, a portion of the liquid $CO_2$ crystallizes from its liquid phase to a solid or "snow" phase. The snowflakes are retained within extrusion cylinder 22 by screens (not shown) which cover the outlet 23 through which waste gas is discharged. Upon collection of a predetermined amount of such snow within cylinder 22, a hydraulic ram 24 drives a piston forward within extrusion cylinder 22 to compress the snowflakes to a solid block, which in turn is extruded through a die and breaker plate or pelletizer 25.

The resulting solid $CO_2$ pellets pass through pellet conduit 28 to diverter means 50. During the initial start-up of the subject particle-blast cleaning apparatus, extrusion cylinder 22 and pelletizer 25 must chill down to proper operating temperature (i.e. about −100° F. or −74° C.). During this chill-down time, imperfect pellets often result which are preferably disposed of as opposed to being run through the entire apparatus. It is for this reason that it is preferred that particle-blast apparatus 10 include means 50 for diverting these imperfect pellets immediately outside of the apparatus. In this regard, diverter means 50 is shown as including a diverter valve 52 which can be hingedly moved between open and closed positions (both positions being shown by the broken lines of FIG. 1—the closed position depicted by the substantially vertical broken lines).

Because it is preferred to maintain portions of the pellet hopper 30 at pressures slightly above atmospheric, it is preferred that diverting valve 52 include sealing means (not shown) for providing an airtight seal in both its open and closed positions. It has been found that such sealing means can adequately be provided by a silicon rubber flexible sealing ring attached about the periphery of diverter valve 52 to provide an interference fit with waste chute 51 and, alternatively, the inner surfaces of diverter conduit 54 which connects pellet conduit 28 and the upper portions of hopper 30. Once extrusion cylinder 22, pelletizer 25 and pellet conduit 28 are sufficiently chilled down, the diverter valve 52 can be closed so that the pellets flow directly into hopper 30 where they are accumulated for subsequent discharge.

Hopper 30 serves to provide surge capacity for apparatus 10 during use, and preferably includes high and low level sensors (e.g. sensors 31 and 32, respectively to indicate the relative level of stored pellets therewithin. In this regard, it is preferred that the sensors be of a pneumatically-operated variety, and that they be operated with carbon dioxide gas. In this way, gas discharged from such sensors will not adversely chemically react with carbon dioxide pellets stored within hopper 30, and additionally such discharged gas can be advantageously utilized to provide a slight positive pressure within hopper 30. This slightly positive pressure of $CO_2$ gas within hopper 30 can in turn be utilized to preclude the influx of ambient air into hopper 30 during pellet transport operations. Particularly, the $CO_2$ gas within hopper 30, being under slight pressure (e.g. approximately 1 psi) will flow outwardly when pellets are discharged from hopper 30 at receiving station 34 thereby preventing the inflow of ambient air which may contain moisture. It is critical that moisture not enter the system, as moisture would quickly freeze at the extremely low temperatures involved herein, which could result in possible freeze-ups of the system or less efficient flow of particles therewithin. From hopper 30, pellets flow by the force of gravity through gravity feed chute 33 to pellet receiving station 34. At pellet receiving station 34, pellets are gravity fed into pellet feeder means 40 for lateral transport to the pressurized discharged system of the apparatus.

Figure 2:
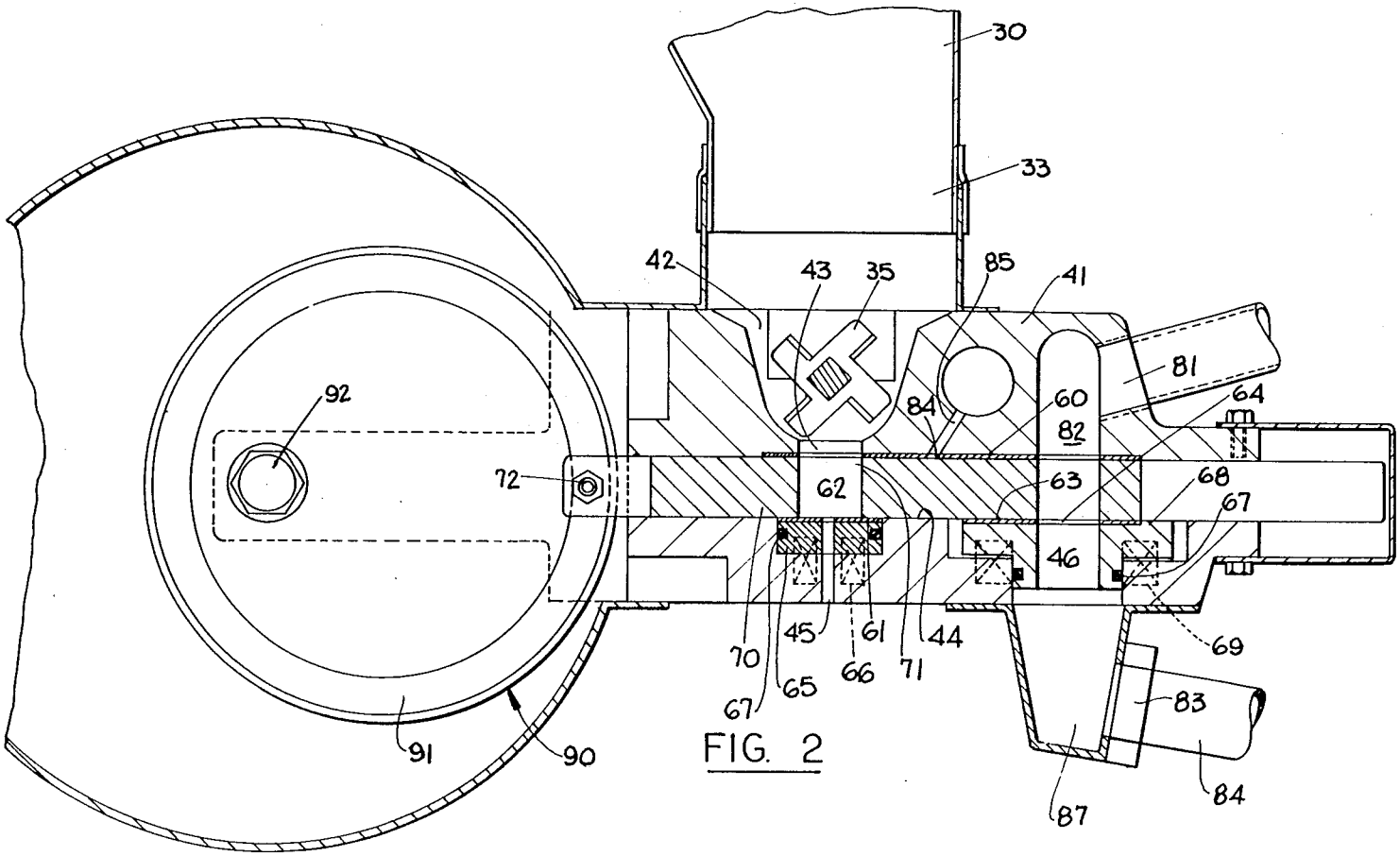
FIG. 2 is a typical cross sectional view of the pellet feeder means of FIG. 1 showing a pellet feeder bar with its transport bar indexed at the discharge station.

FIG. 2 shows an enlarged cross-sectional view of pellet feeder means 40. In particular, hopper 30 and its gravity feed chute 33 can be seen as connected to the upper portions of feeder manifold or block 41. From gravity feed chute 33, pellets enter feeder chute extension 42 within which is situated an agitation means 35 to ensure the free flow of pellets from hopper 30 into pellet feeder means 40. As mentioned above, it is important to maintain a slight pressure within the hopper and pellet feeder apparatus to prevent the entrance of any moisture-containing air which could cause individual pellets to freeze together and possibly block or substantially impair the flow of pellets through the system. It is preferred, however, to maintain such pressure at a relatively low value (e.g. 1 psi) because it has been found that pressures above 10 psi tend to diminish the efficiency of the pellet extrusion and forming process described above.

As shown in FIG. 2, receiving station 43 is shown as being in communication with feeder bar channel 44. Feeder bar 70 is shown as being reciprocally mounted within feeder bar channel 44 and attached at connection point 72 to reciprocating means 90. While not critical hereto, for simplicity of manufacture and sealing purposes, feeder bars 70 and feeder bar channels 44 are preferably formed with substantially rectangular cross sections. Reciprocating means 90 is shown as comprising a relatively standard circular track cam 91 being attached to a rotating shaft 92 at a point offset from the center of cam 91, thereby affectively achieving a pure sinusoidal travel pattern and imposing a reciprocating force upon feeder bar 70. Feeder bar 70 is further shown as including a substantially cylindrical vertical transport bore 71 designed to be alternately indexed with receiving station 43 and discharge station 46 as feeder bar 70 is reciprocated by circular cam 91. In this way, transport bore 71 can be aligned with receiving station 43 for gravity feeding and filling of such bore with pellets from hopper 30. The filled transport bore 71 is then laterally reciprocated and indexed with discharged station 46.

It is contemplated that appropriate manifolding can easily be provided to provide gravity feed of the pellets from hopper 30 into a plurality of receiving stations 43 where a plurality of feeder bars 70 are utilized. Likewise, it is similarly contemplated that a simple manifolding arrangement (e.g. collector manifold 87 of FIG. 2) would also be used to direct pellets being discharged at a plurality of discharge stations 46 by the pressurized gas to a single discharge hose 84 and nozzle 85. Because relatively simple manifold structures are contemplated herein, specific details of such are not included.

A source (not shown) of pressurized gas is attached to pressurized gas inlet 81 and its depending gas channel 82 formed within feeder manifold 41. Gas channel 82 is vertically aligned with discharge station 46, and when transport bore 71 is indexed with discharge station 46, the pressurized gas drives the carbon dioxide pellets held therewithin from transport bore 71 through discharge station 46 and out discharge connection 83 where it is conveyed via discharge hose 84 to discharge nozzle 85.

It has also been found that the sinusoidal travel of eccentrically attached circular cam 91 permits a slight pause of feeder bar 70 at the opposite distal ends of its reciprocating travel. In this regard, it is preferred that receiving station 43 and discharge station 46 be located relative one another a distance approximating the overall lateral travel of feeder bar 70. In this way, it can be ensured that the slight pauses inherent in the lateral movement of feeder bar 70 (due to the described sinusoidal movement pattern imposed by offset cam 91) will occur when transport bore 71 is indexed with either the receiving station 43 or discharge station 46. In this way, additional time is provided for proper filling and emptying of transport bore 71 without affecting the rotational velocity of the source of rotation 92. This factor can be very important when it is realized that a plurality of feeder bars 70 can thus be attached to a single source of rotation (i.e. a single rotating shaft driven by a single simple motor), and the single rotating source can be rotated at a steady rate.

As mentioned above, it is important to maintain a slight pressure within the hopper and feeder apparatus of the subject invention to prevent the possible influx of moisture into the system. This pressure, however, is preferably a relatively low pressure. Because it is preferred that air under high pressure be used to convey the laterally transported pellets from the discharge station to the discharge nozzle (e.g. pressures of up to approximately 250 psi), it is imperative that the high pressures present at discharge station 46 be isolated from the much lower pressures present at receiving station 43. To ensure the isolation of such pressure differentials within pellet feeder means 40, feeder bar 70 is to oscillate between a fixed face seal 60 located adjacent the upper surface of feeder bar channel 44 and at least two upwardly and variable biased seals 61 and 63 located adjacent receiving station 43 and discharge station 46, respectively, on the lower surface of channel 44. These seals are preferably made of materials which can maintain their flexibility and seal integrity at relatively low temperatures contemplated herein (e.g. silicone rubber as avialable from various sources such as National Seal, or Multifil tape as available from Garlock Bearings, Thorofare, N.J.) impregnated with teflon or other dry lubricants.

Fixed seal 60 includes apertures corresponding to receiving station 43 and pressurized gas channel 82, respectively, providing communication therethrough to feeder bar channel 44. A third aperture is also shown as being formed to correspond with bleed-off vent 84 and vent channel 85 which are designed to vent any pressure which may remain in transport bore 71 as it is laterally reciprocated from discharge station 46 to receiving station 43. This pressure bleed-off is important to further ensure that ambient air which may contain moisture does not enter into the system during filling operations at receiving station 43. The upward bias of seals 61 and 63 is variable to ensure that sufficient sealing pressure is exerted to ensure uncompromised seal integrity in the system. To provide upward bias to such seals, a bias block 65 is shown as supporting variable bias seal 61 from below, and having a set of four springs 66 therebelow designed to maintain variable upward pressure thereon. It should also be noted that a vent 45 is formed through the lower portions of feeder manifold 41 and bias block 65. A corresponding aperture 62 is formed in seal 61 to allow venting therethrough during filling operations. In particular, vent 45 is preferably one or more small pathways providing direct fluid communication between the feeder bar channel 44 and the surrounding atmosphere such that when transport bore 71 is indexed with receiving station 43, the slightly pressurized environment of hopper 30 will force a small amount of carbon dioxide gas through the pellets being received within transport bore 71, thereby forcing any gas therewithin out of the system via vent 45. This prevents any gas or air which may contain moisture from entering the system.

A similar bias block 68 supports seal 63 adjacent discharge station 46. Seal 63 is similarly formed with aperture 64 coorresponding to the bore formed through bias block 68 in axial alignment with pressurized gas channel 82. Block 68 is biased upwardly by four springs 69 as similarly described above with regard to block 65. Both bias blocks 65 and 68 also may include standard O-ring seals 67 to further minimize the chance of ambient air entering the system. While the variable bias seals 61 and 63 are shown as having their bias pressure imposed by a plurality of springs, it is contemplated that the upward force on such bias blocks might also be imposed by alternate means, such as in a manner similar to the variable force applied to the diaphragm seals described in prior U.S. Pat. No. 4,617,064, referenced above.

Figure 3:
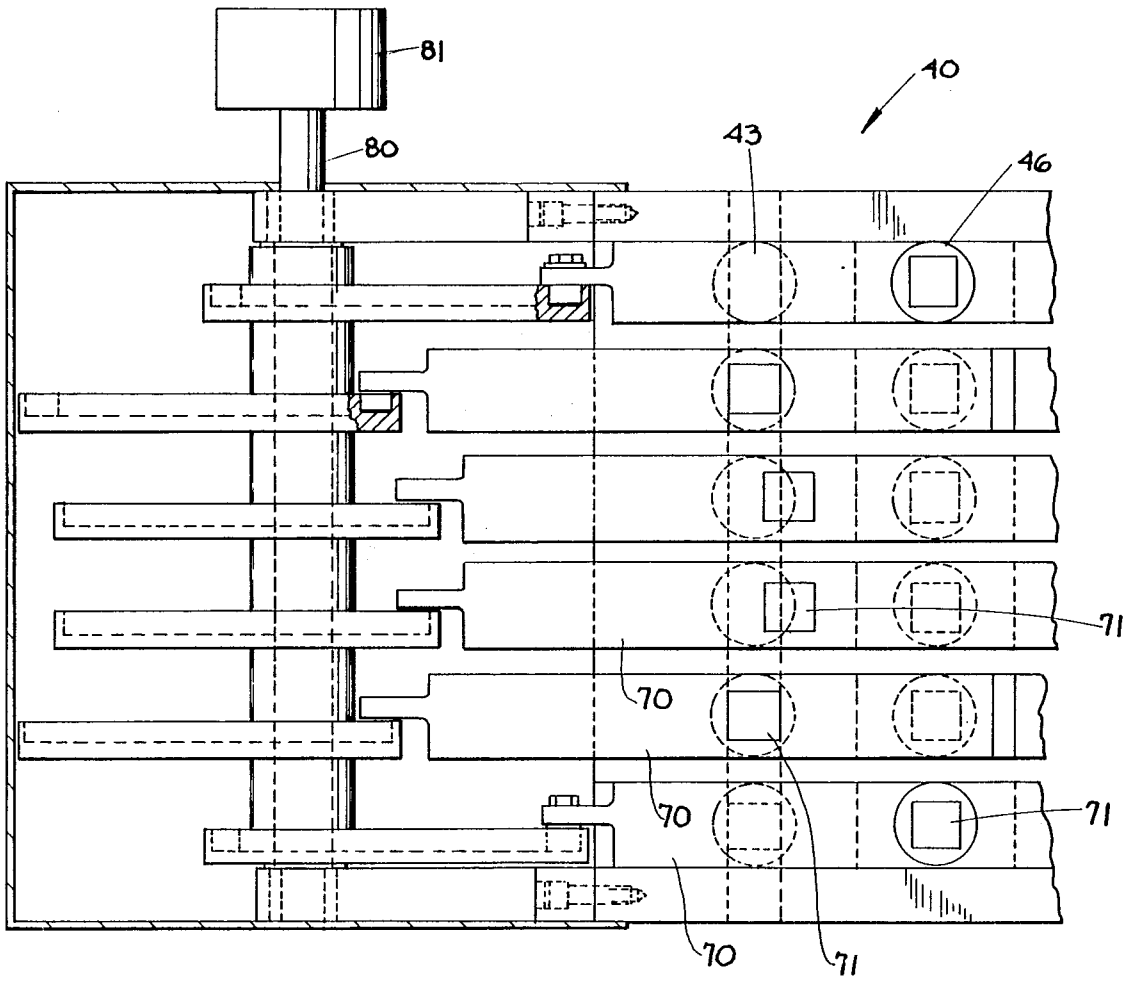
FIG. 3 is a diagrammatical view of the pellet feeder means of the present invention, illustrating a plurality of feeder bars and their circular cams being serially staggered to insure uniform pellet flow.

As best illustrated in FIG. 3, it is contemplated that a plurality of feeder bars 70 are to be combined in a single pellet feeder system 40, and most preferably such feeder bars would be arranged to be reciprocated in a staggered manner to provide a relatively uniform rate of lateral movement of the pellets from the receiving station to the discharge station, thereby providing a uniform rate of discharge of such pellets. Specifically, as shown in FIG. 3, a combination of six (6) lateral feeder bars can be combined such that at any time one of the transport bores 71 of such feeder bars is being filled with pellets at receiving station 43, two are being reciprocated in each direction (a total of 4) between receiving station 43 and discharge station 46, and one is discharging pellets at discharge station 46. It has been found that this serial pattern of staggering is effective in ensuring a relatively uniform rate of transport and discharge of pellets through the system. Of course, a variety of combinations of the number of feeder bars and the exact pattern of staggering could be utilized as desired for any particular application. It is also contemplated that to maximize efficiency of the system, all of the feeder bars could be attached to a common drive shaft (e.g. 80) from a single source (e.g. 81) of rotational energy. While this is the most preferred mode of reciprocating the feeder bars of the subject invention, more than one source of rotational energy and multiple drive shafts could alternatively be utilized.

In order to achieve the most uniform flow of pellets within the present system, it has been found preferable to stagger the reciprocating feeder bars in seriatim such that subsequent transport bores begin to discharge their dose of pellets prior to the completion of discharge of pellets from one or more transport bores previously indexed at the discharge station. In this way, an overlapping of discharge is maintained, thereby ensuring uniformity of pellet flow.

In use, the sublimable carbon dioxide pellets are formed and provided via the surge capacity hopper 30 to a receiving station 43. A plurality of feeder bars 70 each having a transport bore 71 formed therein are reciprocated such that the transport bores 71 are alternately indexed with receiving station 43 and a discharge station 46. The sublimable pellets are gravity fed into transport bores 71 of feeder bars 70 when the respective transport bores are indexed with receiving station 43. The reciprocating feeder bars thereafter are reciprocated laterally to transport the bores filled with such pellets from receiving station 43 to discharge station 46. Pressurized transport gas (preferably air) is supplied at discharge station 46 for discharging the pellets from the transport bores 71 when such transport bores are indexed with the discharge station. The discharged pellets are thereafter conveyed to a discharge nozzle 85 for subsequent impingement with a surface to be cleaned by the particle-blast system.

Having shown and described the preferred embodiment of the present invention, further adaptions of the cleaning apparatus and method can be accomplished by appropriate modifications by one of ordinary skill in the art without departing from the scope of the present invention. Accordingly, the scope of the present invention should be considered in terms of the following claims and it is understood not to be limited to the details of structure and operation shown and described in the specification and drawings.

It is claimed:

1. An improved particle-blast cleaning apparatus featuring sublimable pellets as the particulate media, said apparatus comprising:

(a) a source of sublimable pellets;

(b) housing means having spaced pellet receiving and discharge stations;

(c) pellet feeder means for transporting said pellets from said receiving station to said discharge station, said pellet feeder means further comprising a plurality of reciprocating feeder bars each having a transport bore formed therein to receive said pellets for lateral transport between said receiving and discharge stations and arranged to be reciprocated in a staggered manner to provide a relatively uniform rate of transport and discharge of such pellets;

(d) means for providing gravity flow of said pellets to said transport bores at said receiving station;

(e) a discharge nozzle; and (f) means for supplying a pressurized transport gas at said discharge station for conveying said pellets from said discharge station to said discharge nozzle.

2. The particle-blast cleaning apparatus of claim 1, wherein said pellet feeder means includes six or more feeder bars reciprocably mounted in corresponding feeder bar channels.

3. The particle-blast cleaning apparatus of claim 2, wherein said pellet feeder bars are reciprocated by a single reciprocating source.

4. The particle-blast cleaning apparatus of claim 3, wherein said pellet feeder bars are each connected to said single reciprocating source by a circular track cam arrangement, each such cam being eccentrically attached to said reciprocating source in order to achieve sinusoidal travel and thereby imparting reciprocating lateral movement to said pellet feeder bars.

5. The particle-blast cleaning apparatus of claim 4, wherein said pellet feeder bars are substantially rectangular in cross-section and are reciprocated within correspondingly shaped feeder bar channels, and wherein said feeder bar channels include pressure control means to isolate said receiving station from the pressurized environment at said discharge station.

6. The particle-blast cleaning apparatus of claim 5, wherein said pressure control means further comprises a plurality of air seals between said pellet feeder bars and said channels, and a pressure release port located between said receiving and discharge stations.

7. The particle-blast cleaning apparatus of claim 6, wherein said air seals include a fixed seal and two or more variably biased seals whose sealing pressure can be varied as needed, said variable bias seals being respectively located adjacent said receiving and discharge stations.

8. The particle-blast cleaning apparatus of claim 7, said apparatus further comprising a pellet diverting means to divert pellets from said housing means for disposal when desired, said diverting means including a diverting valve having open and closed positions, and means for providing an air tight seal about the periphery of said diverting valve in both said open and closed positions.

9. An improved particle-blast cleaning apparatus featuring sublimable pellets as the particulate media, said apparatus comprising:

(a) a source of sublimable pellets;

(b) housing means having spaced pellet receiving and discharge stations;

(c) pellet feeder means for transporting said pellets from said receiving station to said discharge station, said pellet feeder means further comprising at least six reciprocating feeder bars each having a transport bore formed therein to receive said pellets for direct lateral transport between said receiving and discharge stations, the transport bore of any particular feeder bar being alternately indexed with said receiving and discharge stations, said feeder bars are arranged to reciprocate in a staggered manner to provide a relatively uniform rate of transport and discharge of such pellets;

(d) means for providing gravity flow of said pellets to said transport bores at said receiving station;

(e) a discharge nozzle; and (f) means for supplying a pressurized transport gas at said discharge station for conveying said pellets from said discharge station to said discharge nozzle.

10. The particle-blast cleaning apparatus of claim 9, wherein said pellet feeder bars are serially arranged.

11. The particle-blast cleaning apparatus of claim 10, wherein said pellet feeder bars are reciprocated by a single reciprocating source.

12. The particle-blast cleaning apparatus of claim 11, wherein said pellet feeder bars are each connected to said single reciprocating source by a circular track cam arrangement, each such cam being eccentrically attached to said reciprocating source in order to achieve sinusoidal travel and thereby imparting reciprocating lateral movement to said pellet feeder bars.

13. The particle-blast cleaning apparatus of claim 12, wherein said pellet feeder bars are substantially rectangular in cross-section and are reciprocated within correspondingly shaped feeder bar channels, and wherein said feeder bar channels include pressure control means to isolate said receiving station from the pressurized environment at said discharge station.

14. The particle-blast cleaning apparatus of claim 13, wherein said pressure control means further comprises a plurality of air seals between said pellet feeder bars and said channels, and a pressure release port located between said receiving and discharge stations.

15. The particle-blast cleaning apparatus of claim 14, wherein said air seals include a fixed seal and two or more variably biased seals whose sealing pressure can be varied as needed, said variable bias seals being respectively located adjacent said receiving and discharge stations.

16. The particle-blast cleaning apparatus of claim 15, said apparatus further comprising a pellet diverting means to divert pellets from said housing means for disposal when desired, said diverting means including a diverting valve having open and closed positions, and means for providing an air tight seal about the periphery of said diverting valve in both said open and closed positions.

17. The particle-blast cleaning apparatus featuring sublimable pellets as the particulate media, said apparatus comprising:

(a) a source of sublimable pellets;

(b) housing means having spaced pellet receiving and discharge stations;

(c) pellet feeder means for transporting said pellets from said receiving station to said discharge station, said pellet feeder means further comprising at least six feeder bars reciprocably mounted in corresponding feeder bar channels, said feeder bars each having a transport bore formed therein to receive said pellets for direct lateral transport between said receiving and discharge stations, the transport bore of any particular feeder bar being alternately indexed with said receiving and discharge stations, said feeder bars being reciprocated by a single reciprocating source in a serially staggered manner relative one another to provide a relatively uniform rate of lateral movement of said pellets from said receiving station to said discharge station;

(d) means for providing gravity flow of said pellets to said transport bores at said receiving station;

(e) a pellet diverting means which can divert said pellets from said housing means for disposal when desired, said diverting means including a diverting valve having open and closed positions and means for providing an air tight seal about the periphery of said diverting valve in both said open and closed positions;

(f) a discharge nozzle; and (g) means for supplying a pressurized transport gas at said discharge station for conveying said pellets from said discharge station to said discharge nozzle.

18. The particle-blast cleaning apparatus of claim 17, wherein said pellet feeder bars are each connected to said single reciprocating source by a circular track cam arrangement, each such cam being eccentrically attached to said reciprocating source in order to achieve sinusoidal travel and thereby imparting reciprocating lateral movement to said pellet feeder bars.

19. The particle-blast cleaning apparatus of claim 18, wherein said pellet feeder bars are substantially rectangular in cross-section and are reciprocated within correspondingly shaped feeder bar channels, and wherein said feeder bar channels include pressure control means to isolate said receiving station from the pressurized environment at said discharge station.

20. The particle-blast cleaning apparatus of claim 19, wherein said pressure control means further comprises a plurality of air seals between said pellet feeder bars and said channels, and a pressure release port located between said receiving and discharge stations.

21. An improved method for laterally transporting sublimable pellets in a particle-blast cleaning apparatus comprising the steps of:

(a) providing a source of sublimable pellets to a receiving station;

(b) reciprocating a plurality of feeder bars each having a transport bore formed therein, with such transport bore being alternately indexed with said receiving stationaand a laterally spaced discharge station wherein said plurality of feeder bars are reciprocated in a serially staggered manner to provide a relatively uniform rate of transport of said pellets to said discharge nozzle of said cleaning apparatus;

(c) providing a gravity feed of said pellets into said transport bores of said feeder bars when the respective transport bores are indexed with said receiving station;

(d) reciprocating said feeder bars such that said transport bores are moved laterally from said receiving station to said discharge station;

(e) supplying a pressurized transport gas at said discharge station for discharging said pellets from said transport bores; and (f) conveying said pellets to a discharge nozzle.

22. The method of claim 21, further including the step of isolating the pressurized transport gas at said discharge station from the receiving station.

* * * * *